US012352038B2

(12) United States Patent
Wilcoxen

(10) Patent No.: US 12,352,038 B2
(45) Date of Patent: Jul. 8, 2025

(54) UTILITY BUILDING MODULE

(71) Applicant: David Wilcoxen, Marana, AZ (US)

(72) Inventor: David Wilcoxen, Marana, AZ (US)

( * ) Notice: Subject to any disclaimer, the term of this patent is extended or adjusted under 35 U.S.C. 154(b) by 0 days.

(21) Appl. No.: 18/193,695

(22) Filed: Mar. 31, 2023

(65) Prior Publication Data

US 2023/0243146 A1 Aug. 3, 2023

(51) Int. Cl.
*E04B 1/348* (2006.01)

(52) U.S. Cl.
CPC .. *E04B 1/3483* (2013.01); *E04B 2001/34892* (2013.01)

(58) Field of Classification Search
CPC ..... E04B 2001/34892; E04B 1/34869
See application file for complete search history.

(56) References Cited

U.S. PATENT DOCUMENTS 3,792,895 A * 2/1974 Paulson ..... B62D 25/2054 451/364
5,735,639 A * 4/1998 Payne ..... B65D 90/0013 588/259
8,397,441 B2 * 3/2013 Wallance ..... E04B 1/348 52/79.1
9,121,168 B2 9/2015 Levy et al.
10,449,904 B2 * 10/2019 Feinberg ..... B60R 3/007
10,518,823 B1 * 12/2019 Childress ..... B62D 33/08
10,731,329 B1 * 8/2020 Novikov ..... E04B 1/3483
10,800,619 B2 * 10/2020 Ramos ..... E01D 15/24
11,597,588 B2 * 3/2023 Luis y Prado ..... B65D 88/022
2014/0007522 A1 1/2014 Wallace
2016/0160515 A1 6/2016 Wallace
2023/0145279 A1 * 5/2023 Snorrason ..... E04B 1/34861 52/79.1
2023/0243146 A1 * 8/2023 Wilcoxen ..... E04B 1/3483 52/79.5

* cited by examiner

*Primary Examiner* — Andrew J Triggs
(74) *Attorney, Agent, or Firm* — University of Arizona IP Clinic

(57) ABSTRACT

A building module that can accommodate wiring, plumbing, insolation, stairs, and any other device or material desired in construction of structures involving intermodal containers. Embodiments of the building module contain spaces and joist structure, which can provide support for one or more intermodal containers. The joist structure can include several perpendicular beams in a grid formation. These beams can have openings for the purpose of lightening the structure, saving on materials, and allowing space for utility materials such as wiring, plumbing, and other implements used in the walls, floors, and ceilings of structure construction. Building module embodiments can also be used as a header to stabilize walls for the addition of doorways and windows.

5 Claims, 6 Drawing Sheets

UTILITY BUILDING MODULE

BACKGROUND/SUMMARY

There is a need in the art for a building module that improves construction relating to intermodal containers, such as shipping containers, freight containers, or CONEX™ boxes. In modern intermodal container constructions, utilities such as wiring and plumbing take up space inside the living area of the intermodal container. Often, the floor of the intermodal container is raised to allow for utilities to be laid underneath. This construction takes up limited living space inside the intermodal container. Additionally, intermodal containers often require additional insulation because the metal does not insulate effectively. This insulation also can take up limited living space inside the intermodal container.

BRIEF DESCRIPTION OF THE DRAWINGS

The following figures illustrate certain embodiments and are not intended to limit claim scope.

DETAILED DESCRIPTION OF THE INVENTION

Figure 1:
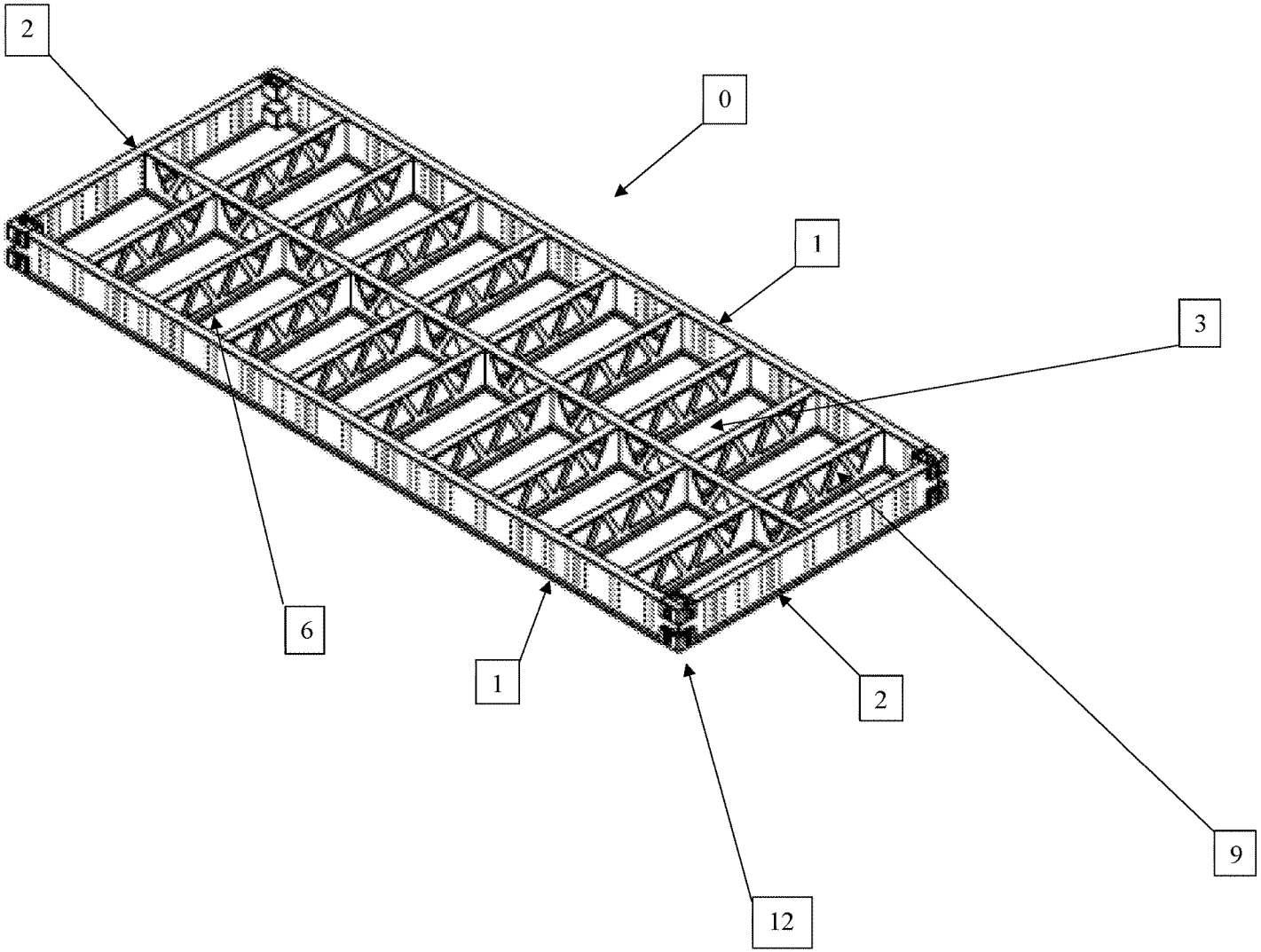
FIG. 1 is a perspective view of an embodiment of a building module featuring parallel length-side and width-side walls.

There is a need to solve the problem of limited space in a shipping container or related structure to add utilities and/or insulation, among other materials. Embodiments described herein provide a solution by allowing for additional space to lay materials that normally would take up interior wall, floor, or ceiling space.

In one embodiment, a building module can accommodate wiring, plumbing, insolation, stairs, and any other device or material desired in construction of structures involving intermodal containers. A building module 0 comprises two parallel length-side walls 1 and two parallel width-side walls 2. Moreover, the building module 0 contains spaces 3 and joist structures 6, which can provide support for one or more intermodal containers. The joist structure of the embodiment in FIG. 1 includes several perpendicular I-beams in a grid formation. The joist structure 6 can include openings 9 and comprise any joist layout and any type of beam known to a person of skill in the art.

The inner beams of the joists 6 can have openings 9 for the purpose of lightening the structure, saving on materials, and allowing space for utility materials such as wiring, plumbing, and/or any other system used in structure construction. These openings 9 are often referred to as lightening holes. The openings in the embodiment in FIG. 1 are triangular shaped. In some embodiments, the openings 9 can be in shape of a circle, ellipse, rectangle, hexagon, or any other shape. The edges of the openings 9 may be flanged to increase the rigidity and strength of the structure. Alternatively or in addition, the openings 9 may have rounded edges and corners to prevent cutting. The openings 9 may be located a designated length from the ends of the structure to limit stress and strain.

The building module can be any dimensions necessary to accommodate wiring, plumbing, insolation, stairs, and any other device or material required in construction of structures involving containers. The building module can be any length and width but must have dimensions to accommodate the desired intermodal container. In some embodiments, the dimensions of the building module will have a length about the same as the standards for ISO (International Organization for Standardization) standard intermodal containers. Standard lengths of ISO compliant intermodal containers can be 10 feet, 20 feet, 40 feet, 45 feet, or 56 feet. Standard height of ISO compliant intermodal containers can be 8 feet or 9 feet and 6 inches.

Figure 2:
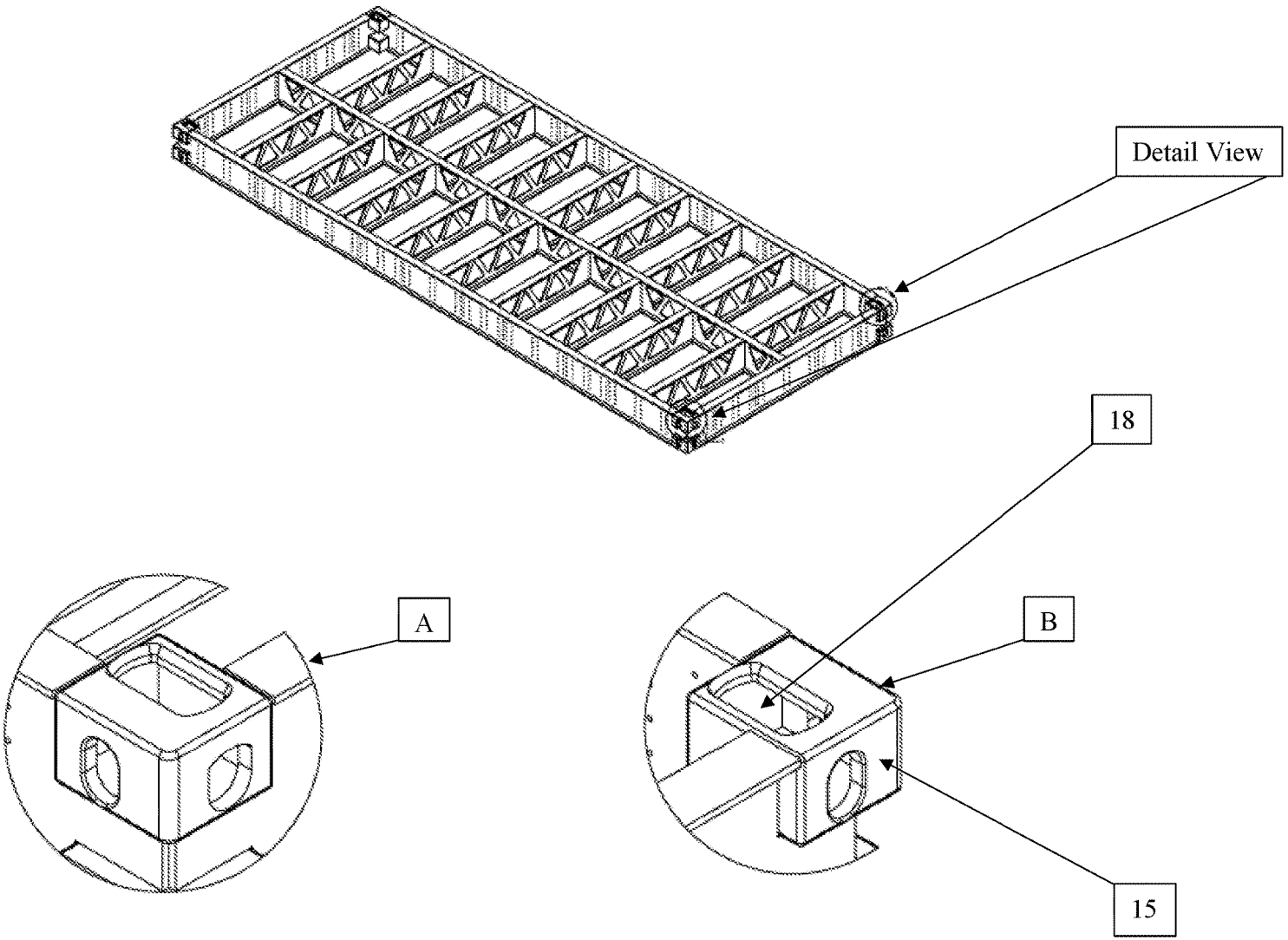
FIG. 2 is a perspective view of the building module in FIG. 1 which depicts magnified views (A and B) of the corner portions of the module.

As shown in FIG. 2, each corner 12 of the building module 0 can be equipped with a corner fixture 15 that is coextensive with at least a portion of the exterior surface a length-side and width-side wall. These corner fixtures 15 have holes referred to as corner fittings 18. The corner fittings 18 are configured to mate with corresponding corner fittings of an intermodal container. Indeed, corner fittings 18 may be configured to mate with any corner fitting of any intermodal container. In some embodiments, the corner fitting 18 can be configured to mate with the standard corner fitting of an ISO standard intermodal container.

Figure 3:
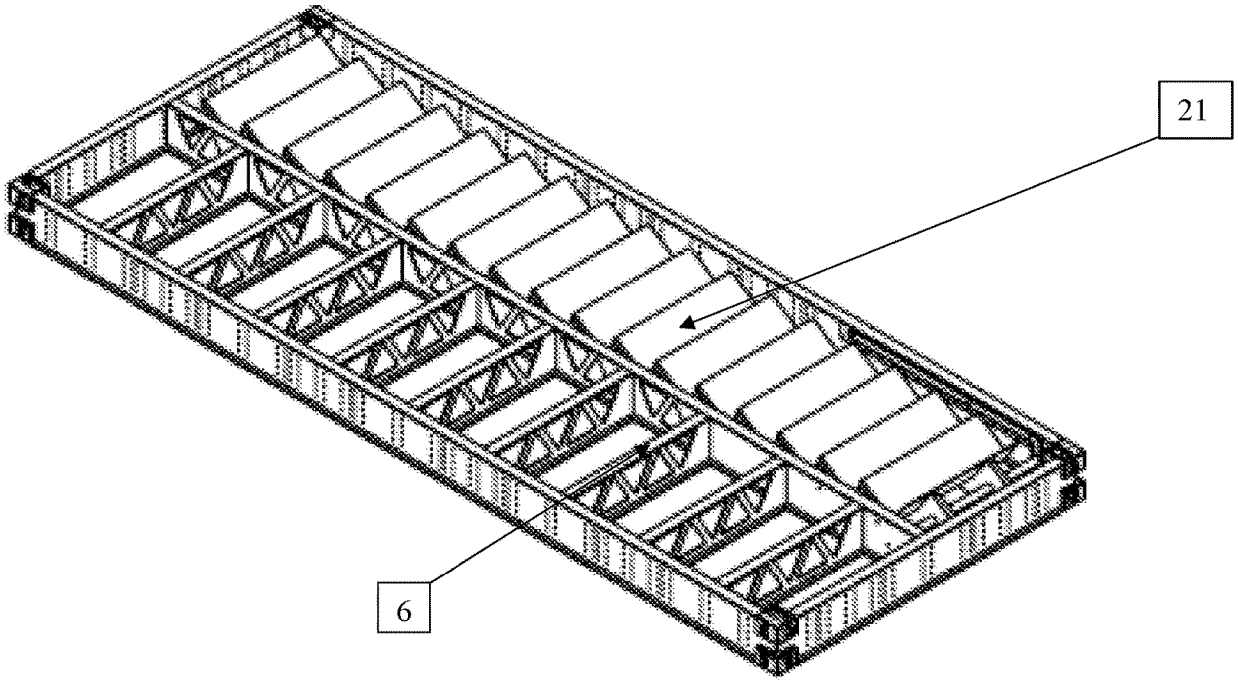
FIG. 3 is a perspective view of an embodiment of the module with stairs in a stored configuration.
Figure 4:
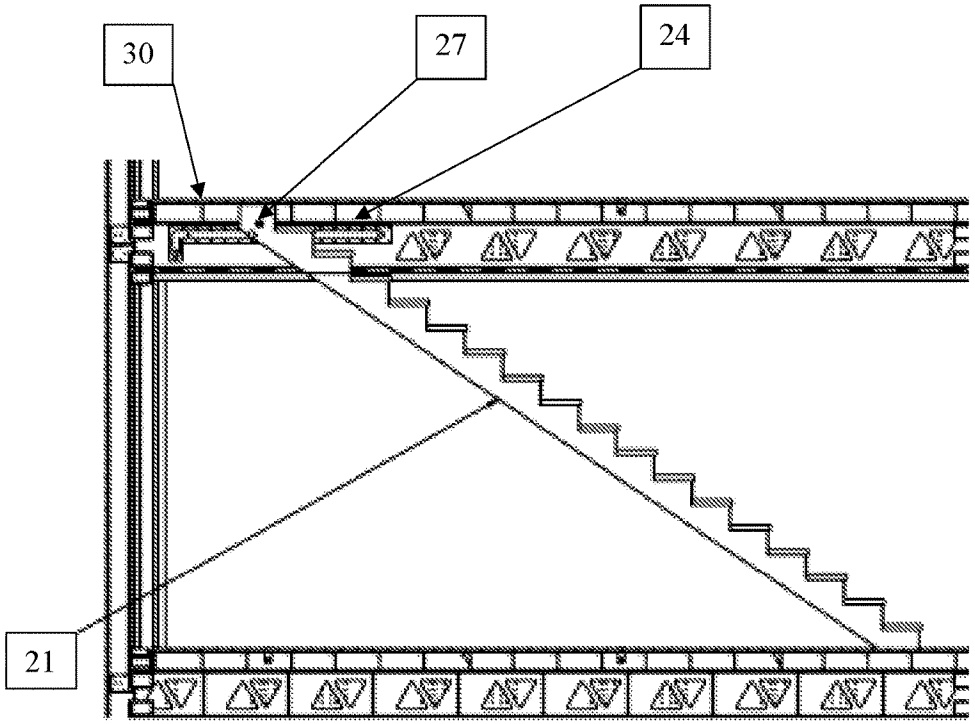
FIG. 4 is a side view of an embodiment with stairs in a down configuration.
Figure 5:
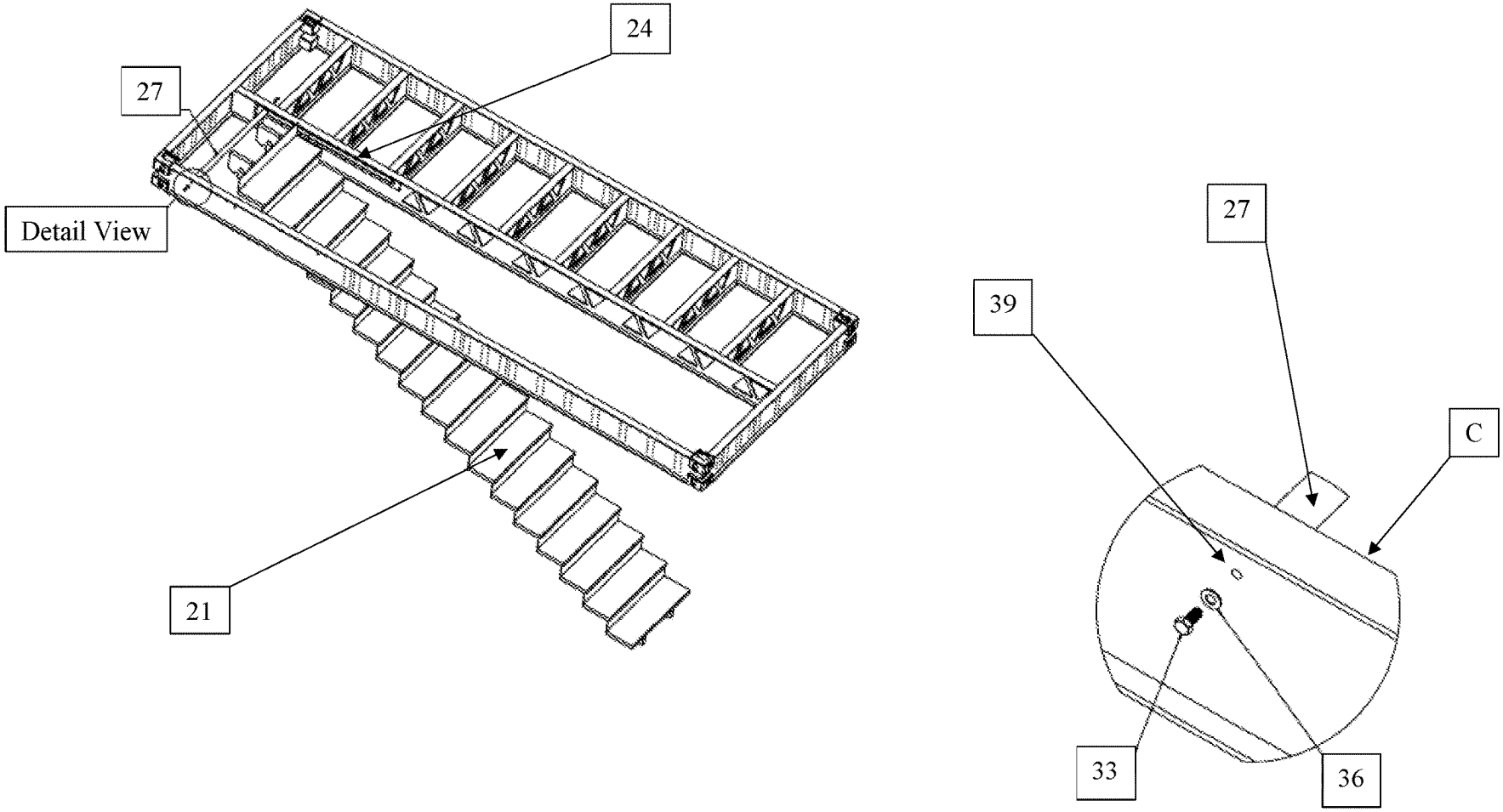
FIG. 5 is a perspective view of an embodiment of the invention with stairs in a down configuration with a detail view (C) of stair hinge region.

In some embodiments, the building module can include space to store stairs 21, as shown in FIG. 3. The stairs 21 may be stored to ease shipping or construction. One section of the joists 6 may be removed to make space for the stairs 21. In some embodiments, the stairs 21 may be configured to drop down from a stored position once the building module is in place, as shown in FIGS. 4 and 5.

In such embodiments, the stairs 21 may be connected to a bracket 24. The stairs 21 may be connected to the bracket 24 with a threaded rod 27. The threaded rod 27 may be tightened in place by inserting a bolt 33 and a washer 36 or nut at the end of the rod 27 through two holes 39 in the bracket 24 and tightening with a wrench. The bracket 24 may be equipped with a number of holes such that the landing 30 of the stairs is adjustable along an axis parallel to the length of the bracket 24.

Figure 6:
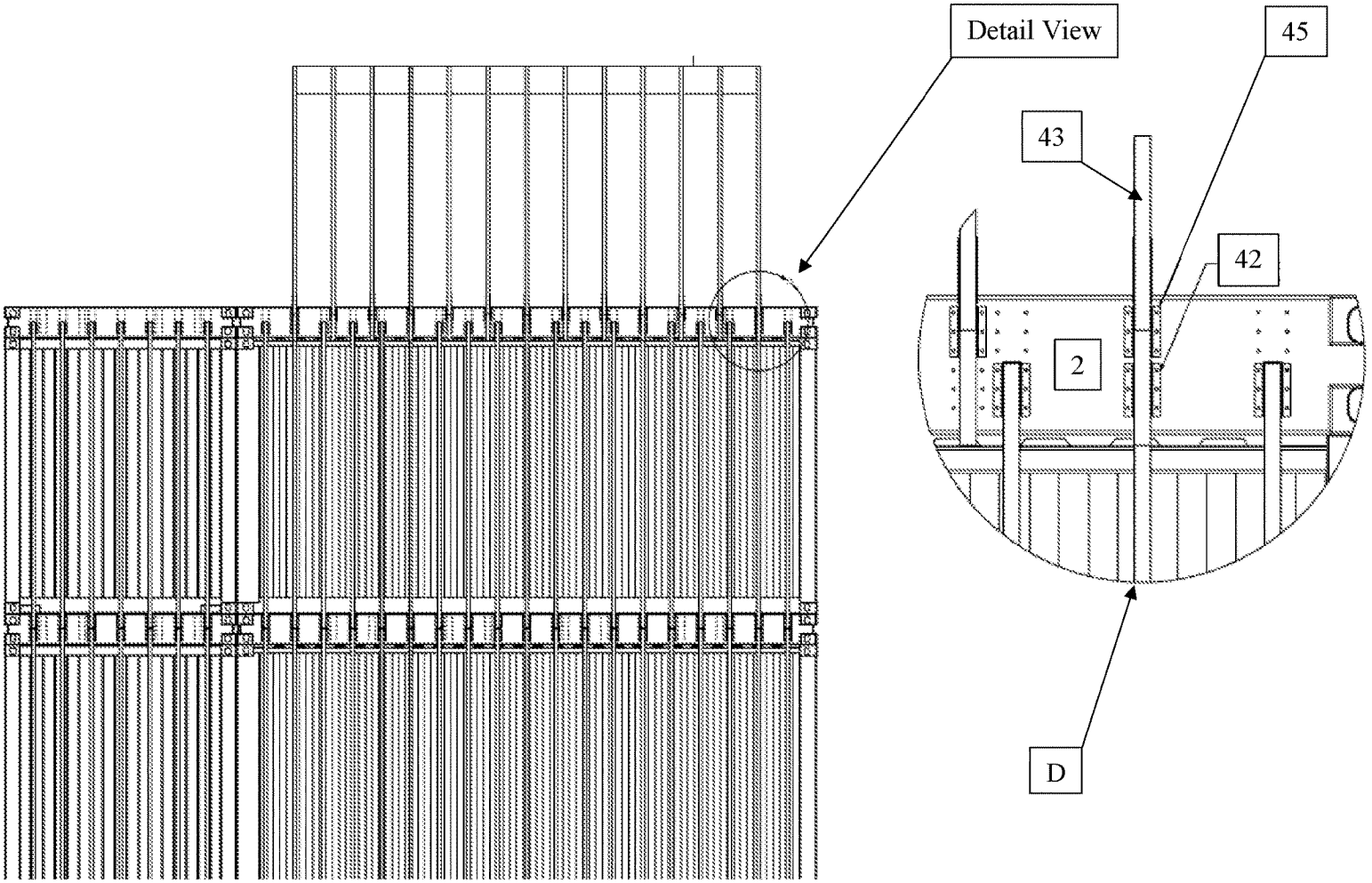
FIG. 6 is a side view of an embodiment of the invention with a bracket structure as shown in magnified view (D).

As shown in FIG. 6, some embodiments of a building module can include vertical brackets 42, which allow for the attachment of additional insulation or additional utility connections such as wiring, plumbing, and/or any other system used in structure construction. Top brackets 45 can be used to attach a roof joist platform on the top of the building module.

In further embodiments, a building module can also be used as a header to stabilize walls for the addition of doorways and windows. Floor joist embodiments also are contemplated.

The following claims are not intended to be limited by the figures and embodiments disclosed herein, but, rather, are meant to fully encompass all equivalent embodiments:

1. A building module, comprising:

two parallel length-side walls coupled to two parallel width-side walls, the two parallel length-side walls and width-side walls defining four corners;

at least one beam extending within the parallel length-side walls and coupled to a second beam extending between two of the parallel width-side walls, wherein the at least one beam and second beam contain a plurality of openings within said beams and located a distance away from each beam end, wherein at least one corner further comprises a corner fixture and a corner fitting, the corner fixture being coextensive with at least a portion of an exterior surface a length-side wall and a width-side wall of said corner, and the corner fitting comprising an opening configured to mate with a corresponding corner fitting of an intermodal container; and wherein stairs are housed within the parallel length-side walls, the stairs are operatively connected at a bracket such that a landing of the stairs is configured to be adjustable along an axis parallel to a length of the bracket, and the stairs are connected to a threaded rod, the threaded rod connected to the bracket.

2. The module of claim 1, wherein multiple of said beams extend between two of the parallel length-side walls and parallel width-side walls, and the corner fitting is configured to mate with a standard corner fitting of an International Organization for Standardization (ISO) standard intermodal container.

3. The module of claim 1, wherein the plurality of openings are configured in the shape of a triangle.

4. The module of claim 1 wherein the stairs are configured to pivot between a down position and a stored position.

5. The module of claim 1 wherein one or more of the two parallel length-side walls and two parallel width-side walls further comprise one or more vertical brackets.

* * * * *